US006648750B1

(12) United States Patent
Wiseman

(10) Patent No.: US 6,648,750 B1
(45) Date of Patent: Nov. 18, 2003

(54) VENTILATION ASSEMBLIES

(75) Inventor: Julian Wiseman, Great Yeldam (GB)

(73) Assignee: Titon Hardware Limited, Colchester (GB)

( * ) Notice: Subject to any disclaimer, the term of this patent is extended or adjusted under 35 U.S.C. 154(b) by 0 days.

(21) Appl. No.: 09/831,098

(22) PCT Filed: Sep. 4, 2000

(86) PCT No.: PCT/GB00/03391

§ 371 (c)(1),
(2), (4) Date: May 3, 2001

(87) PCT Pub. No.: WO01/18458

PCT Pub. Date: Mar. 15, 2001

(30) Foreign Application Priority Data

Sep. 3, 1999 (GB) ..... 9920883

(51) Int. Cl.[7] ..... E06B 7/02; F24F 13/24

(52) U.S. Cl. ..... 454/195; 381/71.5; 454/211; 454/213; 454/906

(58) Field of Search ..... 454/195, 211, 454/213, 254, 271, 276, 906; 181/224, 225; 381/71.5

(56) References Cited

U.S. PATENT DOCUMENTS

| | | | | | |
|---|---|---|---|---|---|
| 4,596,033 | A | * | 6/1986 | Swinbanks | 381/71.12 |
| 4,736,677 | A | * | 4/1988 | Smith | 454/213 |
| 4,815,139 | A | * | 3/1989 | Eriksson et al. | 381/71.11 |
| 4,876,722 | A | * | 10/1989 | Dekker et al. | 381/71.5 |
| 4,905,579 | A | * | 3/1990 | Dame | 136/291 |
| 4,947,434 | A | * | 8/1990 | Ito | 381/71.13 |
| 4,957,038 | A | * | 9/1990 | Hamilton | 454/195 |
| 5,505,659 | A | * | 4/1996 | Hamilton | 454/213 |
| 5,511,127 | A | * | 4/1996 | Warnaka | 181/210 |
| 5,748,750 | A | | 5/1998 | L'Esperance et al. | |
| 6,137,886 | A | * | 10/2000 | Shoureshi | 381/71.2 |
| 6,327,368 | B1 | * | 12/2001 | Yamaguchi et al. | 381/71.5 |
| 6,385,321 | B1 | * | 5/2002 | Krueger et al. | 181/224 |

FOREIGN PATENT DOCUMENTS

| | | | | |
|---|---|---|---|---|
| DE | 29709496 | | 9/1997 | |
| DE | 19742741 | | 4/1999 | |
| EP | 0236557 | | 9/1987 | |
| EP | 0337975 | | 10/1989 | |
| EP | 0599250 | | 6/1994 | |
| EP | 0612057 | | 8/1994 | |
| EP | 0622778 | | 11/1994 | |
| EP | 0837452 | | 4/1998 | |
| FR | 270818 | | 5/1997 | |
| GB | 2155734 | | 9/1985 | |
| GB | 2279846 | | 1/1995 | |
| JP | 3205312 | | 8/1983 | |
| JP | 62-52349 | * | 3/1987 | 454/906 |
| JP | 2-85637 | * | 3/1990 | 454/906 |
| JP | 02085637 | | 3/1990 | |
| JP | 4-324051 | * | 11/1992 | 454/906 |
| JP | 5-223334 | * | 8/1993 | 454/906 |

(List continued on next page.)

OTHER PUBLICATIONS

"A Sound Decision" Housing Association Building and Maintenance, Oct. 1998, pp. 31–32.

*Primary Examiner*—Harold Joyce
(74) *Attorney, Agent, or Firm*—Price, Heneveld, Cooper, Dewitt & Litton

(57) ABSTRACT

A ventilation assembly (10) for a window or door assembly is provided with an anti-sound system (80). The anti-sound system may include a sound generator (82), a noise sensor (88) and an error correction noise sensor (100). A control box (86) is provided for the anti-sound system (80). A solar cell (96) may be provided on a weather canopy (14) of the ventilation assembly for providing power to the control box (86). The ventilation assembly may alternatively comprise a wall vent, chimney or stack vent ventilation system.

32 Claims, 7 Drawing Sheets

FOREIGN PATENT DOCUMENTS

| | | | | |
|---|---|---|---|---|
| JP | 5-223335 | * | 8/1993 | ..... 454/906 |
| JP | 06202670 | | 7/1994 | |
| JP | 7077991 | | 3/1995 | |
| JP | 7162979 | | 6/1995 | |
| JP | 7334170 | | 12/1995 | |
| JP | 7334172 | | 12/1995 | |
| JP | 7334173 | | 12/1995 | |
| JP | 8019083 | | 1/1996 | |
| JP | 8248964 | | 9/1996 | |
| JP | 9319376 | | 12/1997 | |
| JP | 11352972 | | 12/1999 | |
| WO | 93/08560 | | 4/1993 | |
| WO | 93/21688 | | 10/1993 | |
| WO | 93/24994 | | 12/1993 | |
| WO | 94/05005 | | 3/1994 | |
| WO | 94/07303 | | 3/1994 | |
| WO | 94/18616 | | 8/1994 | |
| WO | 94/29846 | | 12/1994 | |
| WO | 94/29848 | | 12/1994 | |
| WO | 95/05136 | | 2/1995 | |
| WO | 95/14988 | | 6/1995 | |
| WO | 95/24171 | | 9/1995 | |
| WO | 96/02910 | | 2/1996 | |
| WO | 96/11466 | | 4/1996 | |
| WO | 96/35313 | | 11/1996 | |
| WO | 97/50078 | | 12/1997 | |
| WO | 98/16916 | | 4/1998 | |

* cited by examiner

VENTILATION ASSEMBLIES

CROSS-REFERENCE TO RELATED APPLICATIONS

This application is the National Stage of International Application No. PCT/GB00/03391, filed in Great Britain on Sep. 4, 2000 designating the United States of America and which was published in English on Mar. 15, 2001, and which claims priority to UK Patent Application No. 9920883.7, filed Sep. 3, 1999.

The present invention relates to ventilation assemblies, such as window or door ventilation assemblies.

A known ventilation assembly comprises a passageway having two ends, one said end being locatable for communication with an interior space, the other said end being locatable for communication with a further space exterior to the interior space for passively permitting ventilation between the interior and exterior spaces.

In some locations, such as housing near motorways or airports or in city centres, such as on Brownfield sites, the noise exterior to a building, such as from aircraft or vehicles, may be relatively loud. Therefore, double glazing or secondary glazing systems have been developed for minimising the effects of such noise inside buildings. However, it is a requirement under building regulations for some interior spaces or rooms to be ventilated and, for this purpose, it is known to provide a ventilation slot through a head section of a window frame. However, a problem is that noise can travel from the exterior atmosphere through the ventilation slot, into the interior space or room concerned, thereby, to a certain extent defeating the purpose of noise attenuation features employed, such as double glazing or other forms of multiple glazing. It is known to provide what is known as an acoustic ventilator which incorporates foam defining a tortuous path through the ventilator. To be effective, such ventilators have to be large and bulky in construction, and they are very expensive. Some persons claim that small slotvents or canopies have acoustic attenuation properties, but it has been pointed out in "A Sound Decision", pages 31 to 32, Housing Association and Building Maintenance, October 1998 that such devices may be no more effective than their standard slot ventilators/canopy counterparts and that an effective acoustic vent will be physically large with a substantial mass of acoustic foam.

It is known to use an anti-sound system in an aircraft headset and to use an anti-sound system in a motorised/powered ventilation duct in order to counteract the constant noise of the fan motor.

The present invention aims to alleviate the problems of the prior art, and especially in relation to passive ventilation devices or assemblies which do not by virtue of their design and method of operation need a motor.

According to a first aspect of the present invention there is provided a ventilation assembly comprising a ventilation passageway having two ends, one said end being locatable for communication with an interior space, the other said end being locatable for communication with a further space exterior to the interior space for passively permitting ventilation between the interior and exterior spaces, and an anti-sound system for reducing the level, at a location in the interior space, of noise incident upon the passageway in the exterior space.

The ventilation assembly may comprise a wall vent.

Alternatively, the ventilation assembly may comprise a chimney.

The ventilation assembly may alternatively comprise a stack vent ventilation system, for example, a system incorporating a generally vertically extending duct for ventilating rooms through apertures at different heights.

According to a further aspect of the present invention there is provided a window or door ventilation assembly having a ventilation passageway extending from one side of the assembly to another side thereof, and an anti-sound system for reducing the level, at a location on one side of the assembly, of noise incident upon the passageway on the other side of the assembly.

The window or door ventilation assembly may comprise a glazed-in vent in which the passageway is defined by an elongate structure having an elongate body having a channel adapted to be positioned on an edge of a flat panel, e.g. a window pane, with the glazed-in vent being located between the edge of the panel and a frame surrounding the panel.

The window or door ventilation assembly may alternatively comprise a slotvent (or slot ventilator) system which includes a slotvent which is adapted to be mounted at an elongate ventilation slot formed through a section, e.g. a head section, of a window sash or window or door frame and preferably defining at least part of the passageway. The slotvent system may include a weather canopy located on one side of the section which is opposite a side thereof on which the slotvent is mounted.

Alternatively, the window or door ventilation assembly may comprise an elongate vent structure having a duct therethrough defining the passageway, the vent structure being adapted to be located between a peripheral edge of a window or door frame, e.g. the peripheral upper edge of a window frame head section, and a layer of building material spaced from the peripheral edge of the frame.

The window or door ventilation assembly is preferably adapted for location in the region of a window or door with one side thereof and one end of the passageway communicating with an interior space and the other side thereof and another end of the passageway communicating with a further space exterior to the interior space.

A further aspect of the invention provides a ventilated window or door ventilation assembly having a window or door and a window or door ventilation assembly as in the previous aspect of the invention mounted thereon for providing ventilation in the region of the window or door.

A number of preferred features for each aforesaid aspect of the invention will now be described.

Preferably, the interior space comprises a room, e.g. of a building. Preferably, the exterior space comprises the earth's atmosphere.

Preferably, the anti-sound system includes a sound generator, preferably for counteracting, reducing, cancelling and/or attenuating noise. The sound generator may generate sound in phase opposition, e.g. 180° out of phase with, noise.

A plurality of said sound generators may be employed in the anti-sound system.

A said sound generator may be electromagnetic.

A said sound generator may be piezoelectric.

A said sound generator may be electrostatic.

The anti-sound system may include at least one electromagnetic sound generator, as well as either a piezoelectric or electrostatic sound generator or both. An electromagnetic sound generator may be adapted to produce sounds of relatively low frequency and a said electrostatic or piezoelectric sound generator may be adapted to produce sounds of relatively high frequency. The electromagnetic sound generator may have a frequency range lower limit lower than and/or a frequency range upper limit lower than respective lower and upper frequency range limits of the electrostatic or piezoelectric sound generator.

At least one said sound generator may be located in the passageway.

At least one said sound generator may be located to the exterior of the passageway in the exterior space.

At least one said sound generator may be located in the interior space.

The assembly may include a background sound generator for generating sounds in addition to or as an alternative to sounds produced for cancelling, reducing, counteracting and/or attenuating noise. The background sound generator may include a memory device adapted to store background sounds. A selection device may be provided for selecting one or more of a selection of background sounds stored in the memory device. The selection device may comprise a button or other user-operable input device for configuring the background sound generator between an off configuration and one or more background sound selection configurations. The input device may also be adapted for selection of the anti-sound system between on and off configurations thereof.

A said background sound may comprise a simulation of a natural sound, such as that of a stream, weather, such as rain or thunder, the seashore or an underwater environment. A said selected background sound may comprise the sound of at least one animal, such as a bird, mammal or waterborne animal.

A said background sound may comprise music.

An advantage of an assembly including such a background sound generator is that not only may unwanted noise be addressed, but pleasant noises may be generated, such as for the purposes of relaxation, for example, in homes or work places.

Preferably, the anti-sound system includes a noise sensor for sensing noise. A plurality of said noise sensors may be provided.

At least one said noise sensor may be located to the exterior of the passageway, for example, in the earth's atmosphere.

At least one said noise sensor may be located in the passageway of the assembly.

At least one said noise sensor may be located to the interior of the passageway, for example, in a room ventilated by the passageway.

The anti-sound system may include at least one error correction sound sensor. A said error correction sound sensor may be located in the passageway. A said error correction sound sensor may be located in a room ventilated by the passageway.

The anti-sound system preferably includes a control system which is adapted to receive signals from each said noise sensor and to control each said sound generator in response thereto. Where an error correction sound sensor is provided, the control system is preferably adapted to receive error correction signals from the error correction sound sensor and to control the output of at least one said sound generator in response thereto.

The control system may be located in the passageway and may comprise a control box.

The anti-sound system may include a power supply for powering the anti-sound system.

The power supply may include a battery and/or a mains supply, e.g. via a transformer, and/or a solar cell.

In a case where the assembly comprises a window or door ventilation assembly, the assembly may include a weather canopy for minimising the ingress of precipitation, such as rain, into a ventilation slot defining at least part of the passageway. The control system may comprise at least one box, preferably a waterproof/sealed box, located inside the canopy. At least one said noise sensor may be located on or inside the canopy. At least one said sound generator may be located on or inside said canopy. The assembly may include a ventilation control device, such as a slotvent or moveable flap, on a side thereof which is adapted to be located inside a room, with the weather canopy located to the exterior of the room. At least one said error correction noise sensor may be located in or on the canopy and/or in or on the ventilation control device and/or in a room ventilated by the assembly.

The canopy may comprise an elongate body, formed, for example, by extrusion, and may incorporate at least one solar cell located on the canopy. An outer surface of the canopy which extends substantially the length of the ventilation assembly may be substantially covered with one or more said solar cells.

The present invention may be carried out in various ways and a number of preferred embodiments of ventilation assemblies in accordance with the invention will now be described, by way of example, with reference to the accompanying drawings, in which.

Figure 1:
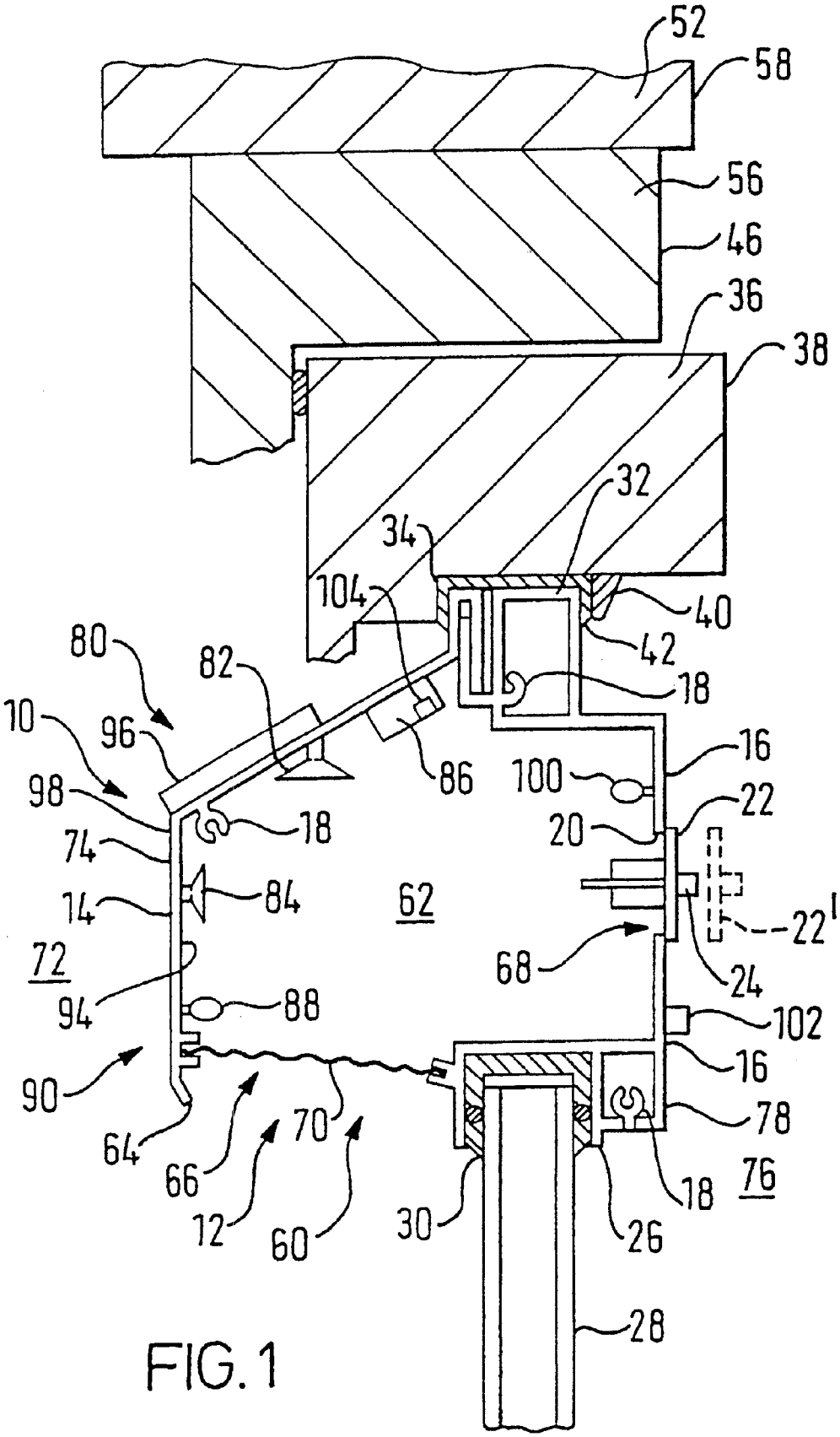
FIG. 1 shows a part sectional side view of a preferred embodiment of a ventilation assembly in accordance with the invention, incorporating a glazed-in vent.

FIG. 1 shows a preferred ventilation assembly 10 in accordance with a preferred embodiment of the present invention. The assembly 10 takes the form of a glazed-in vent 12. The glazed-in vent 12 comprises an elongate weather canopy 14 which is extruded from aluminium; in other embodiments the canopy may be made in other ways, e.g. by moulding or fabrication, and of other materials such as plastics, or it could have a laminated form, for example consisting of layers of the same or different materials. The weather canopy 14 is attached to an elongate front or inner wall 16 which is also an aluminium extrusion, by end caps 18 which, in a conventional manner incorporate screws (not shown) which are screwed into extruded screw-holder formations 18 formed in the weather canopy 14 and front wall 16. The front wall 16 has an elongate aperture 20 cut therethrough and a parallel-motion flap 22 which is moveable (on a linkage (not shown)) away from the closed position shown in FIG. 1 to an open position in which the flap 22 is spaced from the front wall 16, as shown in dotted lines by the reference numeral 22' in FIG. 1, to enable ventilation to pass through the aperture 20. The flap 22 is so moveable by means of a manually operated snib 24, which in other embodiments may be remotely operable, e.g. by a cord (not shown).

Figure 2:
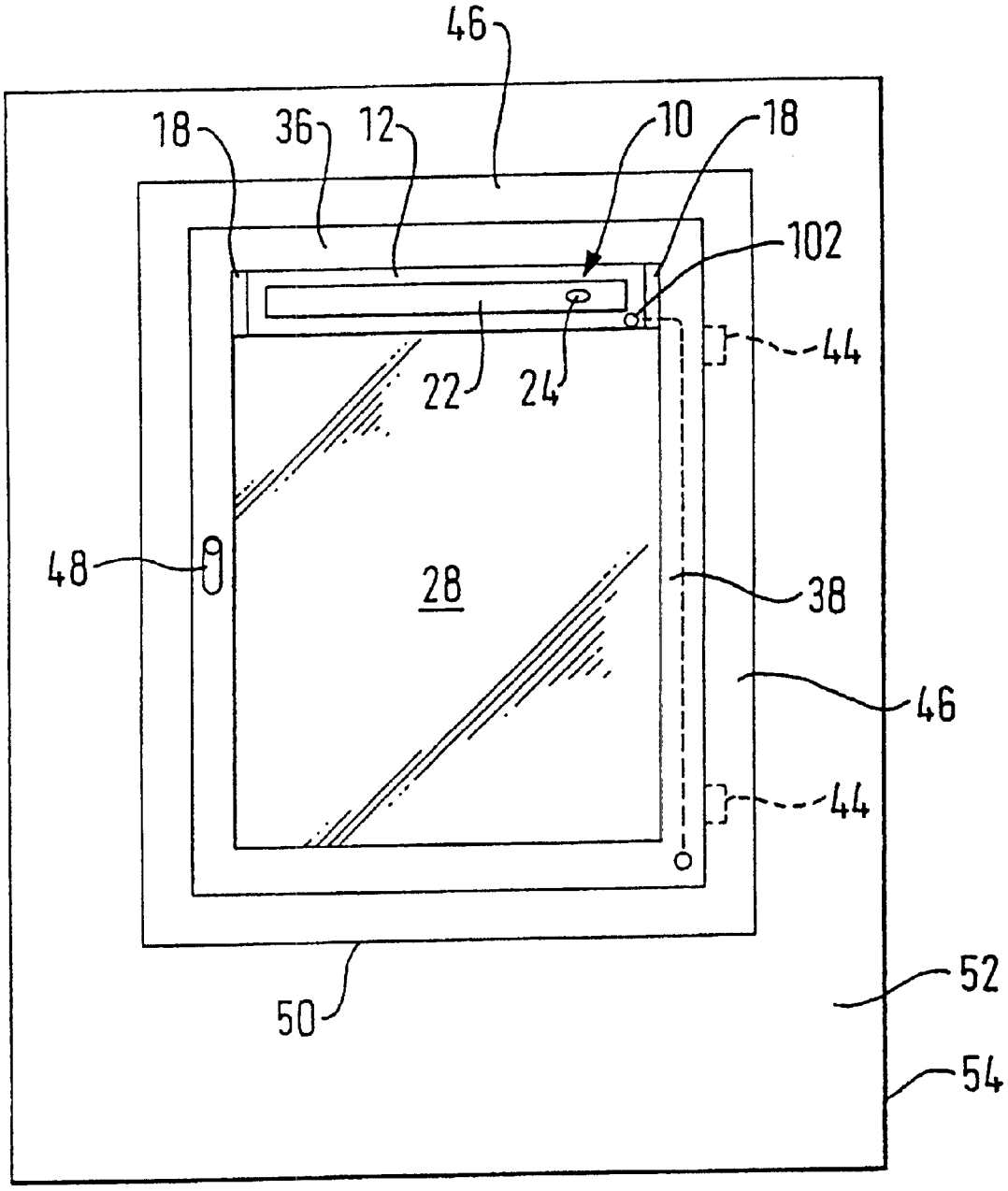
FIG. 2 shows a view of the assembly of FIG. 1 from the interior of a room towards a front of the assembly.

The front or inner wall 16 is integrally formed with a channel portion 26 of the glazed-in vent 12 (which may be separately formed in other embodiments), and the channel portion is adapted to receive therein a double-glazing unit or panel 28 and to be sealed thereto by a longitudinally extending U-shaped seal 30. The glazed-in vent 12 has an elongate upper ridge portion 32 which is adapted to be held between a rebate 34 of a head section 36 of a rectangular window sash 38 and held and sealed thereagainst by a bead 40 and elongate U-shaped seal 42. The sash 38 is pivotally mounted on hinges 44 whose approximate location is shown in FIG. 2, to a rectangular window frame 46 and a handle 48 is provided for selectively latching and/or locking the sash 38 in the closed position thereof shown in FIGS. 1 and 2. The window frame 46 is installed in an aperture 50 formed through a wall 52 of a building 54, and a head section 56 of the window frame 46 sits below a lintel 58 forming part of the wall 52 and is sealed thereto in a conventional manner. An entrance 60 to an airflow passageway 62 of the vent 12 is located between a lower edge 64 of the canopy 14 and the channel portion 26 of the vent 12. The passageway 62 passes from the entrance 60 on one side or end thereof 66 (the left side or end in FIG. 1) to the elongate aperture 20 at the other side or end thereof 68 (the right side or end in FIG. 1).

An insect mesh 70 is provided at the said one end 66 of the passageway 62.

The vent 12, when the flap 22 is open, permits passive ventilation to pass between the exterior atmosphere 72 on an exterior side 74 thereof and a room interior 76 on an interior side 78 thereof.

The vent 12 is provided with an anti-sound system 80 for reducing, attenuating or cancelling noise. The anti-sound system 80 is adapted to minimise the observable level, at a location (not shown) in the room interior 76 of noise, such as aircraft or vehicle noise, incident upon the passageway 62 in the exterior atmosphere 72 at the entrance 60 thereof.

The anti-sound system 80 includes a first sound generator 82 in the form of an electromagnetic speaker, and a second sound generator 84 in the form of an electrostatic or piezoelectric speaker. Several of each of the first 82 and second 84 sound generators may be provided, for example, four of each of the first and second sound generators 82,84, spaced along the length of the vent 12; alternatively one or more of the speakers 82,84 may have a generally elongate construction extending along the vent 12, preferably all or substantially all of the way therealong. The sound generators 82,84 are connected to a control box 86 by wires (not shown) or wireless links and the control box 86 is adapted to generate signals for driving the sound generators 82,84. The electromagnetic speaker 82 may be adapted to produce relatively low frequencies compared to those produced by the electrostatic or piezoelectric speaker 84, and vice versa.

At least one noise sensor 88 is provided in the region of or at the entrance 60 to the passageway 62 for sensing noise incident upon the entrance 60. The control box 86, sound generators 82,84 and noise sensor 88 are located on an interior of a housing 90 defined by the vent 12 and are preferably located on an interior surface 92 thereof which may also be an inwardly facing surface 94 of the canopy 14. Therefore, all of these components may be protected from the weather.

A solar cell 96 is mounted on a outwardly facing surface 98 of the housing 90 or weather canopy 14, the outwardly facing surface 98 being located, once the ventilation assembly is installed, at an angle of approximately 45° to the vertical, for advantageously being exposed to sunlight whether the sun is high or low in the sky.

The solar cell 96 provides power to the control box 86 through wires (not shown) and additionally, or as alternatives to the solar cell 96, the control box 86 and anti-sound system 80 may be powered by a battery or other power-source means, such as from the mains, through a transformer.

An error correction noise sensor 100 is provided in the region of or at the aperture 20. This is a preferred component but maybe omitted in this and other embodiments.

Each sensor 88,100 may comprise a microphone or other form of transducer for converting sound into electric signals or energy, or other forms of signal or energy.

A control button 102 is provided on the interior side 78 of the vent 12 for switching the anti-sound system 80 on or off. When the anti-sound system 80 is switched off, noise such as that of motor vehicles (not shown) or aircraft (not shown) in the exterior atmosphere 72 may disadvantageously pass through the vent 12 through the passageway 62 thereof to the interior side 78 thereof.

However, when the anti-sound system 80 is switched on, the sensor 88 senses the noise and passes a signal to the control box 86 through a wire (not shown) or wireless link. The control box 86 drives the speakers 82,84 to produce sound in opposition such as phase opposition, e.g. 180° out of phase, with the noise, in order to minimise the transmission of noise through the passageway 62, and therefore to reduce or attenuate the level of observed noise on the interior side 78 of the vent 12 and in the room interior 76. The control box 86 is adapted to control the speakers 82,84 in a generally conventional manner, preferably using conventional digital electronics and control algorithms known in the field of anti-sound technology. The error correction sensor 100 may also be employed to provide signals to the control box 86 for error correction. The error correction sensor 100 is further, in this and most preferred embodiments, from the end 66 of the passageway on the exterior side 74 of the vent 12 than the noise sensor 88 and/or sound generators 82,84.

The control button 102 is operable (and preferably is in other embodiments) to select one or more background sounds, as desired, to be played from a memory 104 located in the control box 86 or in a user-operable play device (not shown). The memory 104 may contain background sounds, such as the sounds of streams or birds or underwater sounds or sounds of the seashore, and such sounds may be added to noise attenuation or cancellation signals sent by the control box 86 to the speakers 82,84, for playing the background sounds through the speakers 82,84, along with noise cancellation sounds. Thus, the anti-sound system may not only alleviate, reduce or attenuate unwanted noise if present, but may produce pleasing or relaxing sounds, for the room interior 76, which may comprise a room of a home or workplace or other known form of room.

Although a hinged window assembly has been described above, the invention is also applicate to all other types of window, such as tilt-and-turn, sliding sash, fully reversible and other types.

Figure 3:
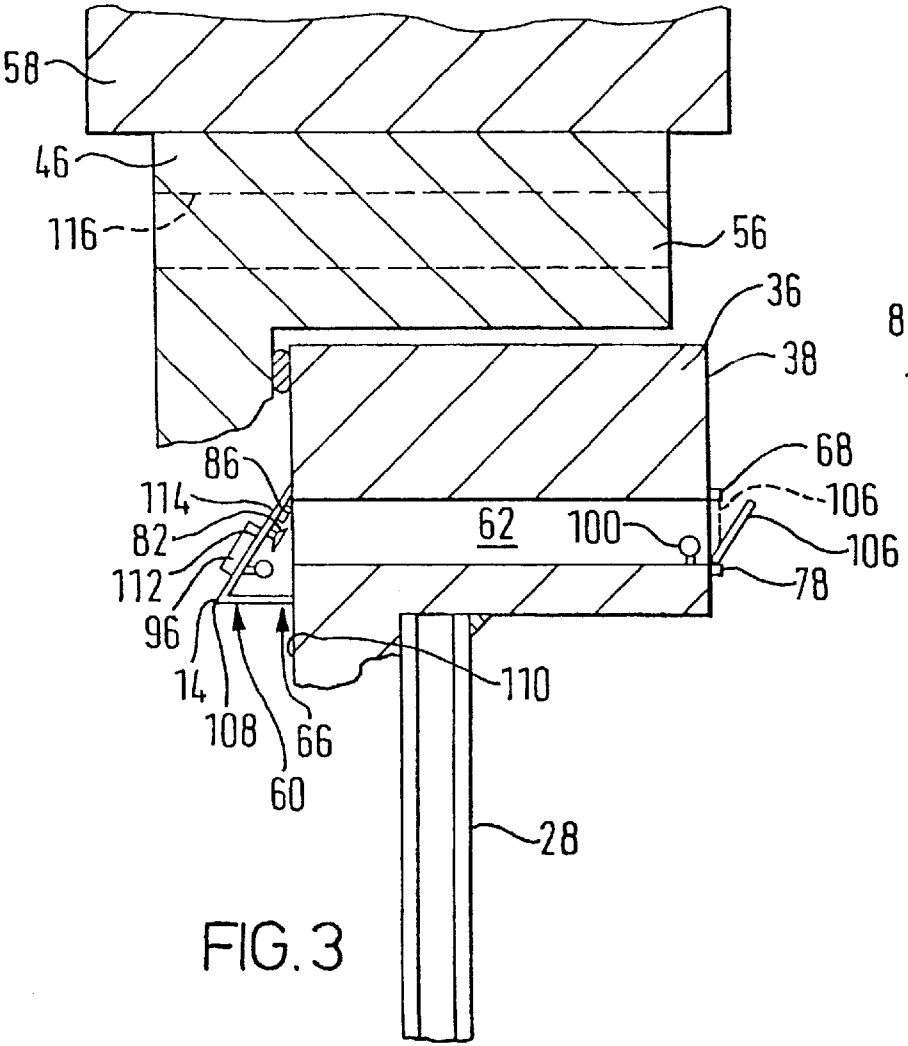
FIG. 3 shows a part-side view of a second preferred embodiment of a ventilation assembly in accordance with the invention, incorporating a slotvent.

FIG. 3 shows another preferred embodiment, in which similar parts to those in the embodiment of FIGS. 1 and 2 are denoted with the same reference numerals.

However, in this embodiment, the ventilation assembly 10 comprises a slotvent assembly 12' comprising a slotvent in the form of a rotatable flap 106 which is rotatable (on a pivot system (not shown)) between the position thereof shown in solid lines (an open position) thereof and the position shown in dotted lines in FIG. 3 which is a closed position thereof in which the adjacent end 68 of the passageway 62 is closed. The slotvent assembly 12' includes at one end of the passageway 62 which is machined as a slot through the head section 36 of the sash 38 the slotvent or flap 106, and at the other end thereof a weather canopy 14. The weather canopy 14 is attached to the head section 36, e.g. by screws and one side or end of the passageway 66 is defined by an entrance 60 to the passageway 62 between a lower edge 108 of the canopy 14 and an exterior face 110 of the head section 36. As in the embodiment of FIGS. 1 and 2, in the embodiment of FIG. 3, the speaker 82, control box 86 and sensor 88 are located on an inner face 112 of the canopy 14 and the solar cell 96 is located on an outer face 114 thereof. The anti-sound system 80 in FIG. 3 works in a similar manner to that shown and described in reference to FIGS. 1 and 2, although in this embodiment, no electrostatic or piezoelectric speaker 84 is provided.

Instead of passing through the sash 38, the slotvent assembly 12' of FIG. 3 (consisting of the flap 106, canopy 14 and anti-sound system 80) may alternatively be associated with a slot 116, shown in dotted lines in FIG. 3, formed through the frame 46, instead of through the sash 38.

Figure 4:
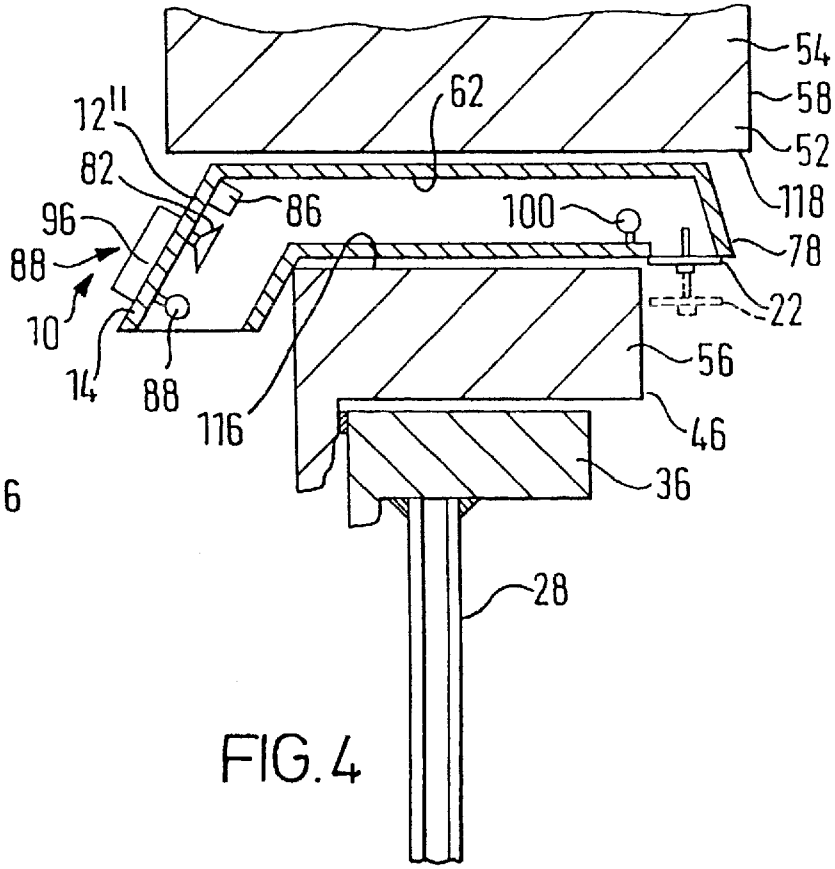
FIG. 4 is a part-sectional side view of a further preferred embodiment of a ventilation assembly in accordance with the invention, including an over-frame vent.

FIG. 4 shows an embodiment in which similar parts are given the same reference numerals to those in the embodiment of FIGS. 1 and 2. The ventilation assembly 10 includes, in the embodiment of FIG. 4, a vent 12" which is adapted for location between an outer or upper peripheral edge 116 of the head section 56 of the window frame and a lower edge 118 of a lintel 58 which forms part of a wall 52 of a building 54. The vent 12" is sealed between the head section 56 and lintel 58 by sealing means (not shown) in a conventional manner.

The vent 12" includes a canopy 14, integral with a passageway 62 thereof. A parallel motion flap 22 is located on an interior side 78 of the ventilation assembly 10 and it is openable and closeable by parallel motion movement on a linkage (not shown).

A control box 86, speaker 82, noise sensor 88 and error correction noise sensor 100 are provided, along with a solar cell 96 and these components are linked, controllable and operable in a similar manner to that in the embodiment of FIGS. 1 and 2. A piezoelectric or electrostatic speaker, as in FIGS. 1 and 2 may be provided in this embodiment and later described embodiments if desired.

Figure 5:
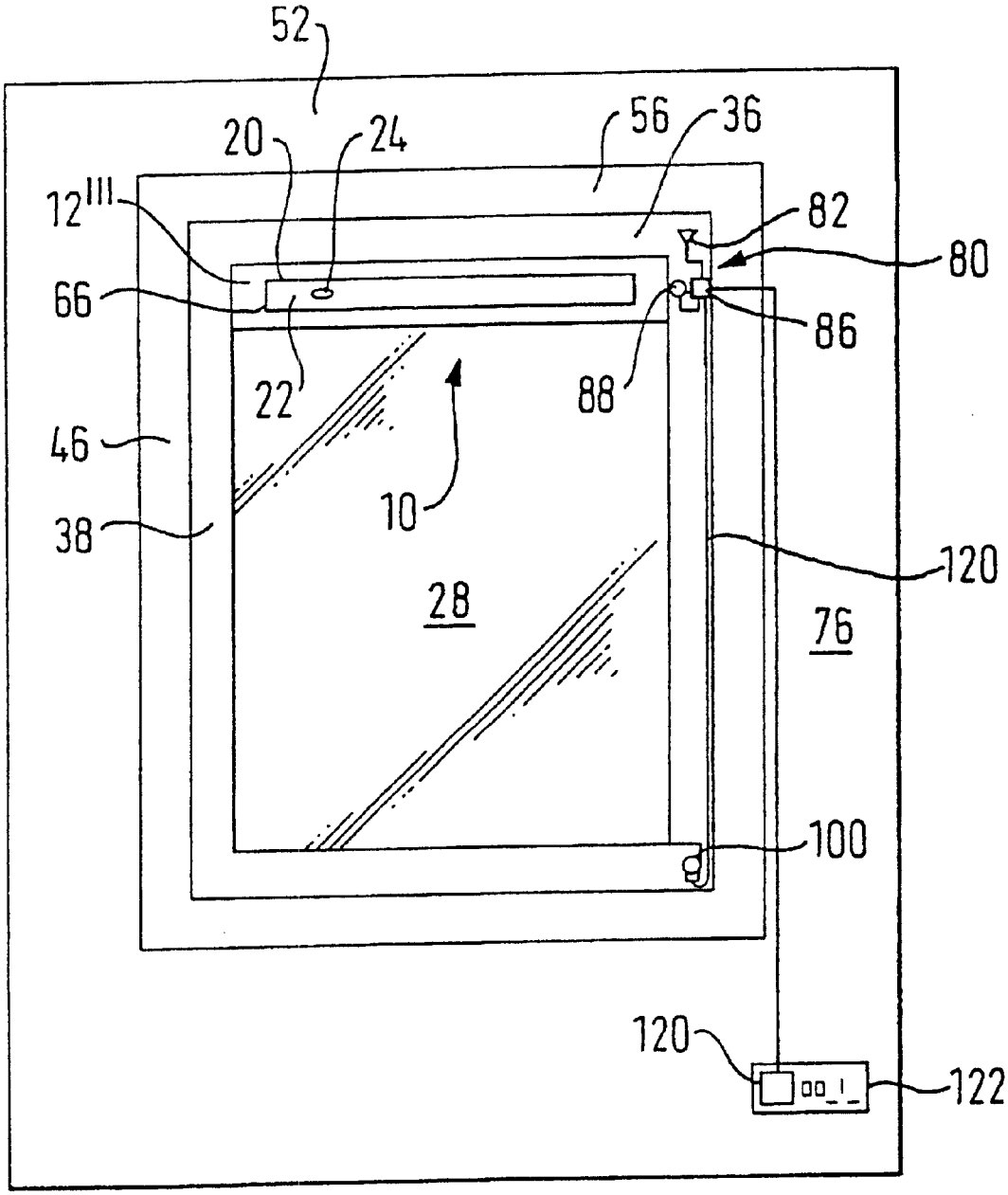
FIG. 5 is a front view of the ventilation assembly including a retro-fitted anti-sound system in accordance with a preferred embodiment of the invention.

FIG. 5 shows an embodiment in which an anti-sound system 80 has been retrofitted to an existing ventilation assembly 10, comprising a glazed-in vent 12'" as described in our UK Patent No. GB2113825B, which has been fitted and glazed-in to a window sash 38 which is mounted in a window frame 46 in a wall 52. Similar components to those in FIGS. 1 and 2 have been given the same reference numerals in the embodiment of FIG. 5. The anti-sound system 80 shown in FIG. 5 is located in a room interior 76 ventilated by the ventilation assembly 10. The ventilation assembly 10 includes a control box 86, sound generator 82, noise sensor 88 and error correction noise sensor 100. These components are mounted on the window sash 38, but each may be mounted to the window frame 46 or wall 52, if desired. These components are connected by wires 120 or wireless links and the control box 86 and anti-sound system 80 are powered through a transformer 120 off a mains power socket 122. The error correction noise sensor 100 is located spaced from the aperture 20 on the interior side or end 66 of the airflow passageway through the known glazed-in vent. The noise sensor 88 and speaker 82 are located relatively close, compared to the error correction sensor 100, to the aperture 20. The anti-sound system 80 in FIG. 5 operates in a generally similar manner to that in the embodiments shown in FIGS. 1 and 2. However, adverse exterior noise is sensed once it has passed into the room interior 76 through the vent 12'". The noise is then sensed by the sensor 88 and cancelled or attenuated by the speaker 82. The error correction sensor 100 provides error correction signals to the control box 86. The anti-sound system 80 and in particular, individual components thereof, such as the speaker 82 may be located in other parts of the room interior 76, such as on the floor or on a stand or shelf (notshown) thereof, such as in a case where the speaker 82 forms a speaker of a sound system or hi-fi in the room interior 76.

Figure 6:
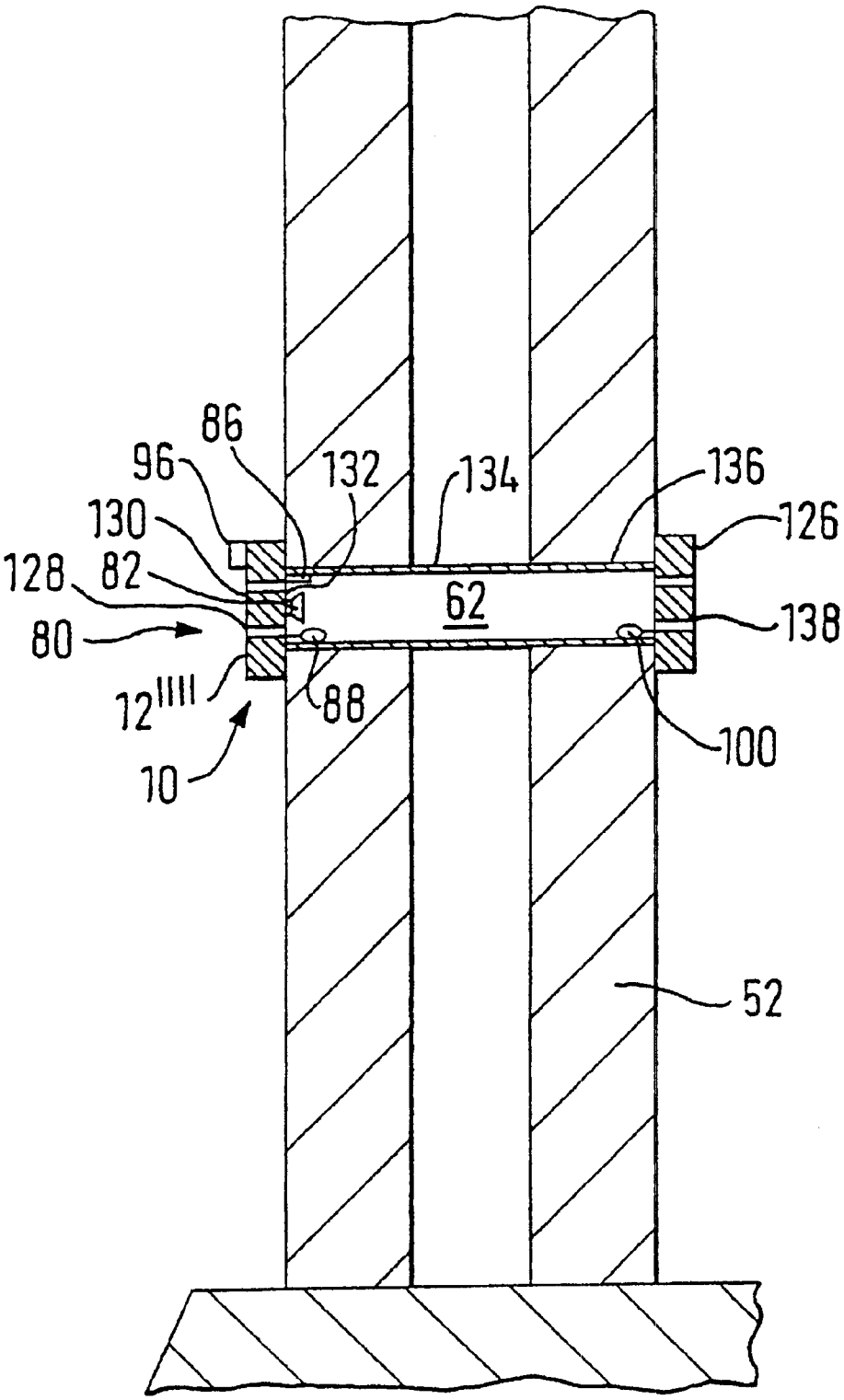
FIG. 6 is a part-sectional side view of a further preferred embodiment of a ventilation assembly in accordance with the invention, including a wall vent.
Figure 7:
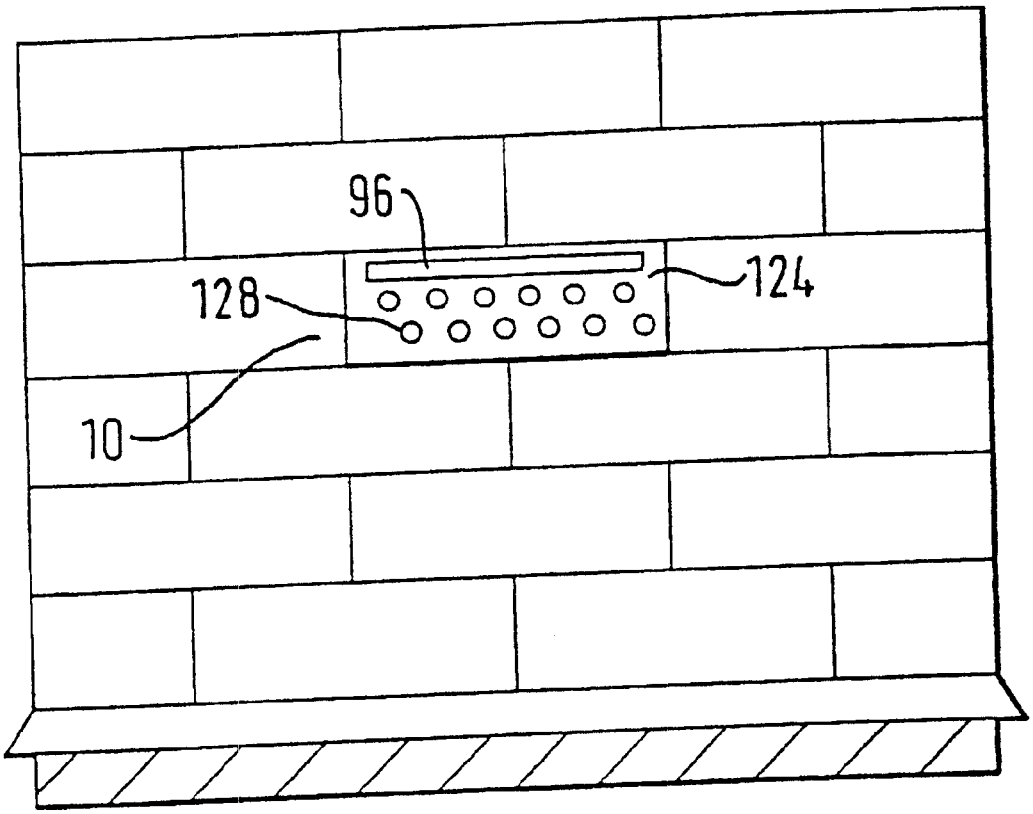
FIG. 7 is a view of part of the assembly of FIG. 6 from the exterior of a room towards an outer plate thereof.

FIGS. 6 and 7 show an embodiment of a ventilation assembly 10 in accordance with a preferred embodiment of the present invention and comprising a wall vent 12"". The wall vent 12"" comprises an outer plate 124 and an inner plate 126. The outer plate has a series of airflow apertures 128 formed therethrough and a solar cell 96 located on and extending along the length of an exterior side 130 thereof, as well as a control box 86, speaker 82 and noise sensor 88 of an anti-sound system 80 located on an inner side 132 thereof. A passageway 62 defined either by a duct member 134 or alternatively simply by apertures or space 136 formed through the cavity wall 52, extends from the outer or exterior plate 124 to the inner or interior plate 126 of the ventilation assembly 10. The interior plate 126 is provided with airflow apertures 138 therethrough and an error correction noise sensor 100 is located on a side thereof facing the outer plate 124. The anti-sound system 80 operates in a manner generally similar to that in the embodiment of FIGS. 1 and 2.

Figure 8:
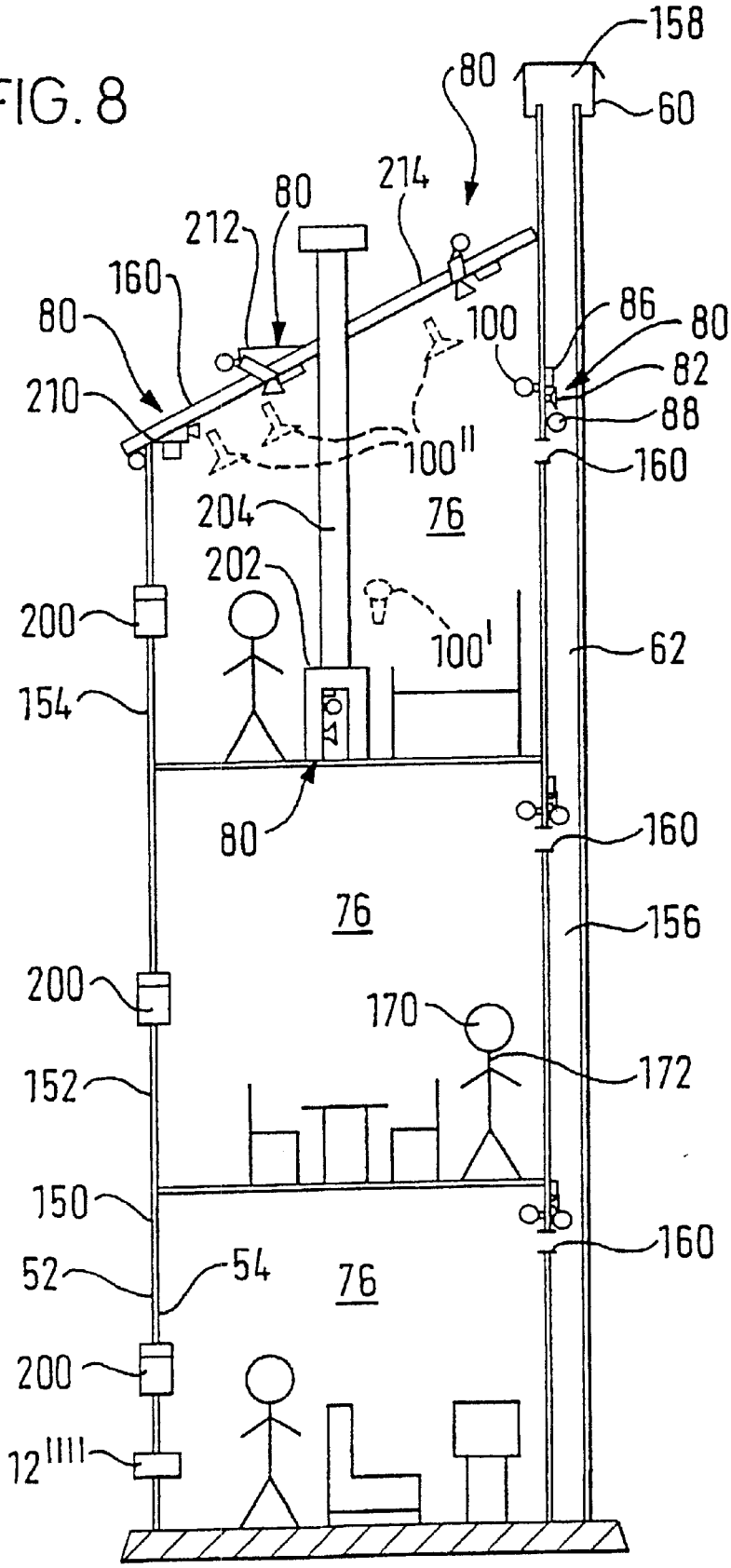
FIG. 8 is a schematic view of a building incorporating various ventilation assemblies in accordance with preferred embodiments of the present invention.

FIG. 8 shows a building 54 to which various ventilation assemblies 10 are fitted. The building 54 has room interiors 76 on three levels 150,152,154. A stack vent or stack vent system 156 comprises a generally vertically extending ventilation passageway 62 which extends from the lowest level 150 up through the middle 152 and upper 154 levels 152 to an upper end 158 thereof above a roof 161 of the building 54. At the upper end 158 of the passageway 62 there is provided an entrance 60 for airflow into or out of the passageway 62. Each of the room interiors 76 includes an entrance 160 into the passageway 62 and an anti-sound system 80 comprising a control box 86, speaker 82, noise sensor 88, and error correction noise sensor 100. Alteratively, a single anti-sound system 80 may be provided in the passageway 62, above the entrance 160 into the upper most level 154 of the building 54. Therefore, when noise, such as aircraft noise passes into the passageway 62, through the entrance 60 thereof, the anti-sound system 80 or systems 80 may attenuate the noise observed by persons 170 located at locations 172 in the room interiors 76.

The room interior 76 of the lower most level 150 includes a wall vent 12"" through a wall 52 of the building, as described with reference to FIGS. 6 and 7, as well as a ventilated window assembly 200 having a glazed-in vent 12 as described with reference to FIGS. 1 and 2, located therein. Such window assemblies 200 are also provided in the wall 52 in the region of the middle 152 and upper 154 levels of the building 54. The upper level 154 includes a fireplace or boiler 202 having a chimney 204, with an anti-sound system 80 located in or in the region of the fireplace 202 or chimney 204. This anti-sound system 80 may use the error correction sensor 100 of another anti-sound system in the room, such as the correction sensor 100 of the stack vent 156. Alternatively, the anti-sound system 80 of the fireplace

202/chimney 204 may use its own error correction sensor 100'. FIG. 8 also shows anti-sound systems 80 fitted to an eaves vent 210, roof vent 212 and roof light 214, such as a velux window type of roof light 214 in which the sound system 80 is adapted to attenuate exterior noise incident upon ventilation passageways of these assemblies 210,212, 214. If desired, these assemblies may use the error correction sensor 100 of the stack vent 156 or may use their own 100" individual sensors In the case of a velux window, having a ventilation slot through a section of a window frame (not shown), the anti-sound system 80 may be located in the region of or at least partly in the slot thereof.

Ventilation systems in accordance with the invention may be incorporated in other types of ventilators or air passages, especially those with a passive nature.

What is claimed is:

1. A ventilation assembly comprising a ventilation passageway having two ends, one said end being locatable for communication with an interior space, the other said end being locatable for communication with a further space exterior to the interior space for passively permitting ventilation between the interior and exterior spaces, and an anti-sound system for reducing level, at a location in the interior space, of noise incident upon the passageway in the exterior space;

wherein the anti-sound system includes at least one electromagnetic sound generator as well as a piezoelectric or electrostatic sound generator, the electromagnetic sound generator being adapted to produce sounds in a first frequency range and the electrostatic or piezoelectric sound generator being adapted to produce sounds in a second frequency range, the second frequency range having an upper frequency limit which is higher than an upper frequency limit of the first frequency range.

2. A ventilation assembly as claimed in claim 1 wherein the ventilation assembly is in a wall.

3. A ventilation assembly as claimed in claim 1 wherein the ventilation assembly is in a chimney.

4. A ventilation assembly as claimed in claim 1 wherein the ventilation assembly is a stack vent ventilation system.

5. A ventilation assembly as claimed in claim 1 wherein the ventilation assembly is a glazed-in vent in which the passageway is defined by an elongate structure having an elongate body and a channel adapted to be positioned on an edge of a flat panel, with the glazed-in vent being located between the edge of the panel and a frame surrounding the panel.

6. A ventilation assembly as claimed in claim 1 wherein the ventilation assembly is a slot vent system which includes a slot vent which is adapted to be mounted at an elongate ventilation.

7. A ventilation assembly as claimed in claim 1 wherein the ventilation assembly is an elongate vent structure having a duct therethrough defining the passageway, the vent structure being adapted to be located between a peripheral edge of a window or door frame and a layer of building material spaced from the peripheral edge of the frame.

8. A ventilation assembly as claimed in claim 1 in which the interior space comprises a room and the exterior space comprises the earth's atmosphere.

9. A ventilation assembly as claimed in claim 1 in which said sound generators are located in the passageway.

10. A ventilation assembly as claimed in claim 1 in which said sound generators are located to an exterior of the passageway in the exterior space.

11. A ventilation assembly as claimed in claim 1 in which said sound generators are located in the interior space.

12. A ventilation assembly as claimed in claim 1 in which the anti-sound system includes a noise sensor for sensing noise.

13. A ventilation assembly as claimed in claim 12 in which said noise sensor is located to an exterior of the passageway.

14. A ventilation assembly as claimed in claim 12 in which said noise sensor is located in the passageway of the assembly.

15. A ventilation assembly as claimed in claim 12 in which said noise sensor is located to an interior of the passageway.

16. A ventilation assembly as claimed in claim 12 in which the anti-sound system includes at least one error correction sound sensor.

17. A ventilation assembly as claimed in claim 16 in which said error correction sound sensor is located in the passageway.

18. A ventilation assembly as claimed in claim 16 in which a said error correction sound sensor is located in a room ventilated by the passageway.

19. A ventilation assembly as claimed in claim 1 and in which the anti-sound system further includes a noise sensor for sensing noise, in which the anti-sound system further includes a control system which is adapted to receive signals from said noise sensor and to control said sound generators in response to said signals.

20. A ventilation assembly as claimed in claim 19 in which the control system is located in the passageway.

21. A ventilation assembly as claimed in claim 1 in which the anti-sound system includes a power supply for powering the anti-sound system.

22. A ventilation assembly as claimed in claim 19 which further includes a weather canopy for minimizing ingress of precipitation into a ventilation slot defining at least part of the passageway.

23. A ventilation assembly as claimed in claim 22 in which the control system comprises at least one box located inside the canopy.

24. A ventilation assembly as claimed in claim 23 in which said noise sensor is located on or inside the canopy.

25. A ventilation assembly as claimed in claim 22 in which said sound generators are located on or inside the canopy.

26. A ventilation assembly as claimed in claim 22 further including a ventilation control device on a side of the ventilation assembly which is adapted to be located inside a room, the weather canopy being located to an exterior of the room.

27. A ventilation assembly as claimed in claim 26 in which said anti-sound system includes at least one error correction noise sensor and in which said at least one error correction noise sensor is located in or on the canopy.

28. A ventilator assembly as claimed in 22 in which the canopy comprises an elongate body.

29. A ventilation assembly as claimed in claim 28 in which at least one solar cell is located on the canopy.

30. A ventilation assembly as claimed in claim 29 in which the canopy has an outer surface extending a substantial length of the ventilation assembly, the outer surface being substantially covered with one or more said solar cells.

31. A ventilation assembly as claimed in claim 13 in which said noise sensor is located in the earth's atmosphere.

32. A ventilation assembly as claimed in claim 15 in which said noise sensor is located in a room ventilated by the passageway.

* * * * *

UNITED STATES PATENT AND TRADEMARK OFFICE

CERTIFICATE OF CORRECTION

PATENT NO. : 6,648,750 B1
DATED : November 18, 2003
INVENTOR(S) : Julian Wiseman It is certified that error appears in the above-identified patent and that said Letters Patent is hereby corrected as shown below:

Column 6,
Line 65, “applicate” should read -- applicable --.
Line 66, “window” should be -- windows --.

Column 9,
Line 23, after “reducing” insert -- a --.

Column 10,
Line 52, before “22” insert -- claim --.

Signed and Sealed this

Twentieth Day of April, 2004

JON W. DUDAS
*Acting Director of the United States Patent and Trademark Office*